United States Patent [19]

Kondo

[11] 4,393,525

[45] Jul. 19, 1983

[54] HEAT-CONTROLLED SANITARY BATHING DEVICE

[75] Inventor: Kenshi Kondo, Tokyo, Japan

[73] Assignee: Nihon Den-Nitsu Keiki Co., Ltd., Tokyo, Japan

[21] Appl. No.: 330,950

[22] Filed: Dec. 15, 1981

[51] Int. Cl.[3] ..... A47K 3/20

[52] U.S. Cl. ..... 4/420.2; 4/420.4

[58] Field of Search ..... 4/420.1–420.5, 4/443–448

[56] References Cited

U.S. PATENT DOCUMENTS

| | | | |
|---|---|---|---|
| 3,154,793 | 11/1964 | Congdon | 4/420.2 |
| 3,947,899 | 6/1976 | Robinson et al. | 4/420.2 X |
| 4,208,746 | 6/1980 | Minamoto et al. | 4/420.2 X |

*Primary Examiner*—Charles E. Phillips

*Attorney, Agent, or Firm*—Stephen F. K. Yee

[57] ABSTRACT

A water-closet with a heat-controlled sanitary bathing device including a heater for heating feed water to a predetermined temperature, a closet seat having a nozzle means for spurting heated water from the heater, a pump for pumping water to the heater and nozzle means, a water flow control valve means for controlling the flow rate of water to the heater, wherein a reflux passage is provided between the water flow control valve and the suction side of the pump to eliminate the variations in water pressure on the delivery side of the pump, which may lead to a trouble of the pump drive motor. The heater has a double vessel construction defining primary and secondary heating chambers each with electric heat control means to provide accurate control of the bathing water.

5 Claims, 13 Drawing Figures

HEAT-CONTROLLED SANITARY BATHING DEVICE

BACKGROUND OF THE INVENTION

This invention relates to a heat-controlled sanitary bathing device, which is intended for use on a water-closet, bidet or the like.

Heat controlled sanitary bathing devices are becoming popular more and more these days. The sanitary bathing device of this sort generally has a pressurized water source, a heater for heating feed water from the source, a bidet portion with a nozzle for spraying heated water from the heater, and a stop valve provided between the pressurized water source and the heater for controlling the flow rate of water to be supplied from the pressurized water source to the heater. In operation, as soon as the stop valve is opened, water is fed from the pressurized water source to the heater, the heated water then being fed to the nozzle of the bidet portion and sprayed toward the user.

In this type of sanitary bathing device, the control of the temperature of feed water has an especially great importance to ensure safe bathing. In a case where a service tap is used as the pressurized water source, it is difficult to effect temperature control because of pressure fluctuations in the service water. Therefore, it is desirable to use a combination of a water reservoir and a pump as the pressurized water source. In this instance, however, there occur pressure variations on the discharge side of the pump according to the open angle of the water cock, and as a result giving rise to variations in the load of the pump motor which could be a cause of motor troubles. Besides, the conventional bathing device is complicated in construction and costly.

SUMMARY OF THE INVENTION

It is therefore an object of the present invention to provide a heat-controlled sanitary bathing device, which is simple and compact in construction.

It is another object of the present invention to provide a sanitary bathing device of the sort mentioned above, which is capable of controlling the temperature of feed water in such a manner as to suppress the temperature variations to a minimum.

It is a further object of the present invention to provide a sanitary bathing device of the sort mentioned above, which is so constructed as to lessen the variations in the load of the water feed pump motor.

BRIEF DESCRIPTION OF THE DRAWINGS

The above and other objects, features and advantages of the present invention will become apparent from the detailed description of the invention which follows, taken in light of the accompanying drawings, in which.

DETAILED DESCRIPTION OF THE PREFERRED EMBODIMENTS OF THE INVENTION

Figure 1:
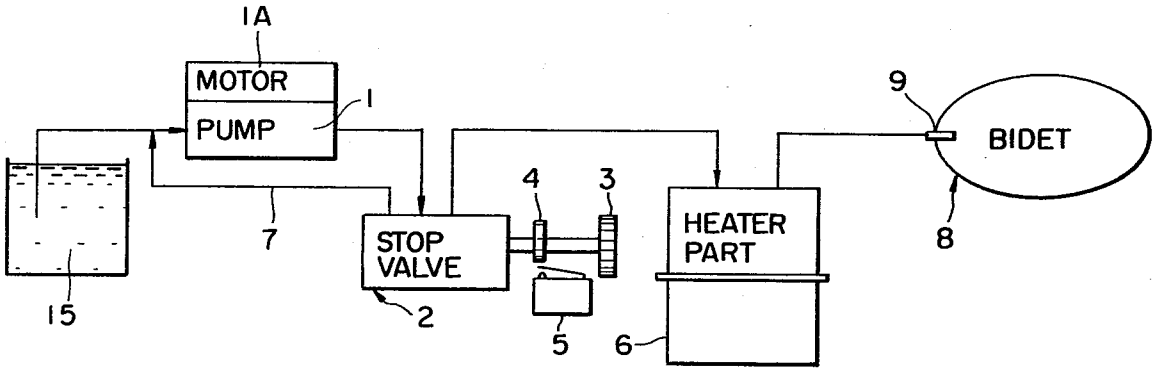
FIG. 1 is a block diagram showing one embodiment of the present invention.

Referring first to FIG. 1, there is shown in a block diagram one embodiment of the present invention, in which indicated at 1 is a water feed pump, at 1A a motor for driving the pump 1, at 2 a stop valve for adjusting the flow rate of water fed by the pump 1, at 3 an adjusting knob for manipulating the water stop valve 2, and at 4 a cam fixed to and rotatable with the adjusting knob 3. The reference numeral 5 denotes an actuator switch which is opened and closed by rotation of the cam 4 on the adjusting knob 3 and electrically connected to the motor 1A for on-off operations thereof. A heater 6 which receives a supply of water from the water feed pump 1 through the stop valve 2 imparts warmth to water. A recirculating passage 7 extends between the stop valve 2 and the suction side of the water feed pump 1 for maintaining the load of the water feed pump 1 constant irrespective of the degree of opening of the water stop valve 2. Designated at 8 is a bidet portion which is provided with a nozzle member 9 to spray therefrom heated warm water toward a bathing body portion of the user on the bidet portion.

Figure 2:
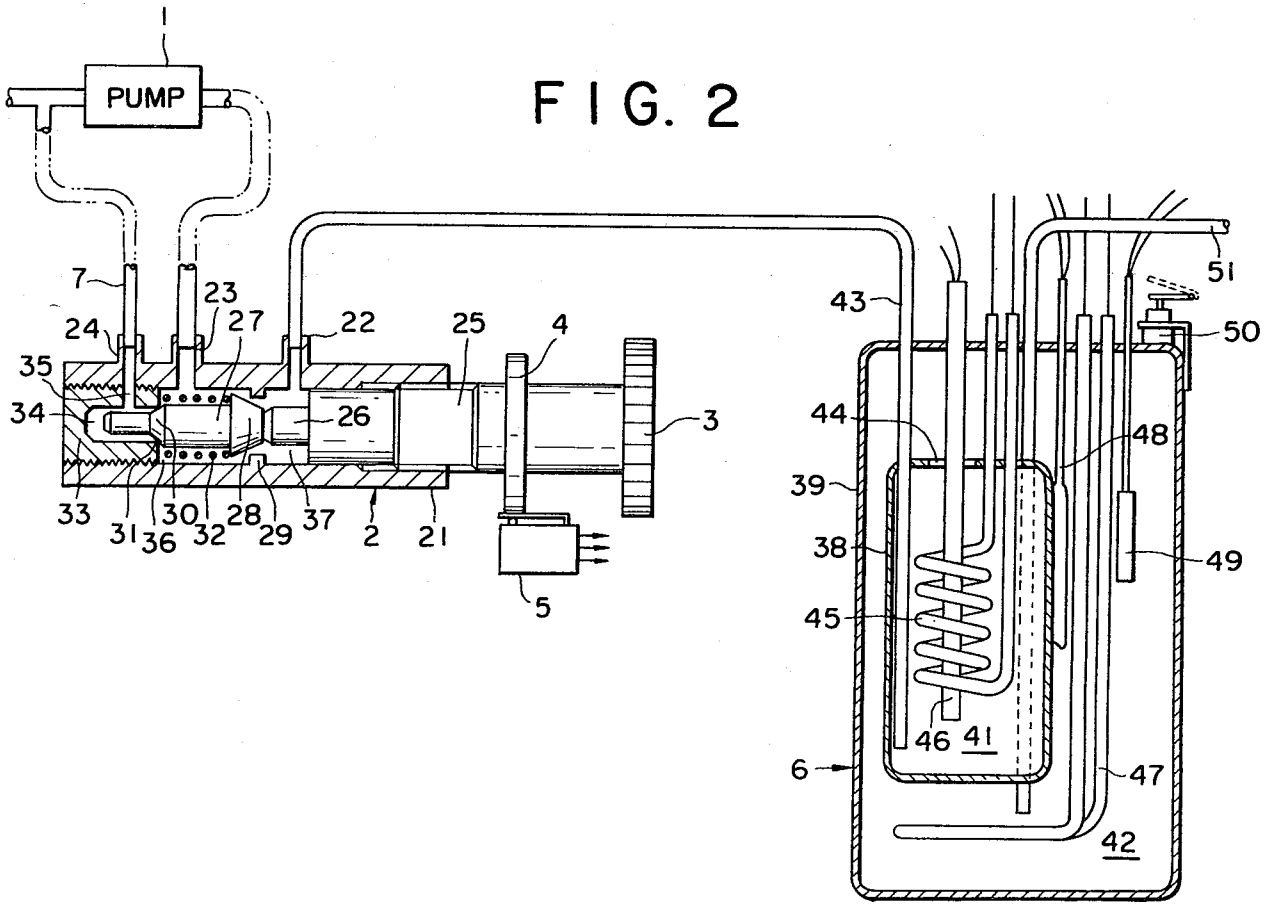
FIG. 2 is a diagrammatic illustration, partly in cross-section, showing a water stop valve and a heater in the embodiment of FIG. 1.

FIG. 2 shows an arrangement of the water stop valve and the heater, wherein those component parts which are common to FIG. 1 are designated by like reference numerals. The water stop valve 2 has a cylindrical valve casing 21 defining therein contiguous, axially aligned, recirculating, supply and discharge chambers 34, 36 and 37. The valve casing 21 is provided with an outlet port 22, an inlet port 23 and a recirculating port 24 such that the discharge, supply and recirculating chambers 37, 36 and 34 may be in fluid communication with the heater 6, the discharge side of the water feed pump 1 and the suction side of the water feed pump 1, respectively. A valve stem 25 which is threaded into the casing 21 is adapted to move in axial direction within the discharge chamber 37 by rotation thereof. One end of the valve stem 25 is protruded from the casing 21, to which and adjusting knob 3 and a cam member 4 are securely fixed. The valve stem 25 is further provided with an axial projection 26 at the other end thereof. A valve plug 27 is provided for axial movement within the supply chamber 36 and has an end face portion in abutting engagement with an end face of the projection 26. The valve plug 27 is provided with a main valve face 28 at one end thereof for engagement with a valve seat 29 provided between the supply chamber 36 and the discharge chamber 37. An auxiliary valve face 30 which is provided at the other end of the valve plug 27 is engageable with an auxiliary valve seat 31 provided between the supply chamber 36 and the recirculating chamber 34. The valve plug 27 is constantly pressed by a coil spring 32 to urge the main valve face 28 in engagement with the main valve seat 29. The biasing force of the coil spring 32 is adjustable through a pressure adjustor 33 which is threaded axially into the other end of the valve casing 21. The recirculating chamber 34 communicates with the recirculating port 24 through a hole 35 provided in the pressure adjustor 33.

The heater 6 has an outer vessel 39. An inner vessel 38 defining a primary chamber 41 therewithin is placed in the outer vessel 39 to define a secondary chamber 42 between them. For example, the primary chamber 41 has a capacity of 50–150 cc and the secondary chamber 42 a capacity of 250–600 cc. A water feed pipe 43 which communicates with the primary chamber 41 is connected to the outlet port 22 of the water stop valve 2 to receive a supply of water directly from the outlet port 22. The inner vessel 28 has a top opening 44 so that the primary chamber 41 may be in fluid communication with the secondary chamber 42. Indicated at 45 is a heating element for heating water in the primary chamber 41, and at 46 a thermostat located in the primary chamber 41 for maintaining the water temperature in the primary chamber 41 at a predetermined level (for example, at a temperature of 35°–40° C.) by controlling the heating element 45. The secondary chamber 42 likewise receives therein a heating element 47 for heating water in the secondary chamber and a thermostat 48 for maintaining the water temperature in the secondary chamber at a predetermined level (for example, at a temperature of 39°–42° C.). Further located in the secondary chamber 42 is a thermal fuse or breaker which stops the operation of the pump 1 when the water temperature in the secondary chamber exceeds the predetermined value. A bimetal type thermostat 50, which has a heat sensing portion disposed in the secondary chamber 42 and a manual resetting mechanism mounted on the outer wall surface of the secondary chamber 42, is adapted to open to stop the operation of the pump 1 when the water temperature in the secondary chamber 42 exceeds the predetermined value. A heated water feed pipe 51 is led out of the secondary chamber 42 to spurt heated water through the nozzle 9 shown in FIG. 1.

The heat controlled bathing type water-closet of the above construction operates in the manner as follows.

Figure 3:
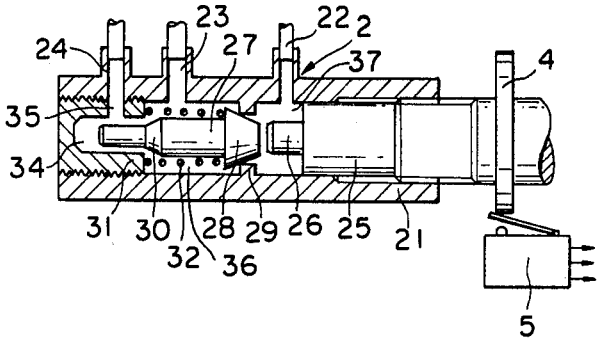
FIG. 3 is a longitudinal section of the water stop valve of FIG. 2 in a fully closed position.

When the water stop valve 2 is in the closed position as shown in FIG. 3, the switch 5 is held open without actuating the water feed pump 1. If the knob 3 is manually rotated into the position shown in FIG. 4, the cam 4 is also turned to close the switch 5 thereby actuating the pump 1. At this time, the main valve face 28 is maintained in pressure contact with the valve seat 29 by the action of the spring 32, so that water which is fed through the inlet port 23 into the supply chamber 36 by the pump 1 is entirely returned to the suction side of the pump 1 through the recirculating chamber 34 without flowing into the outlet port 22. Consequently, no water is sprayed through the nozzle member 9 in this phase of operation.

Figure 5:
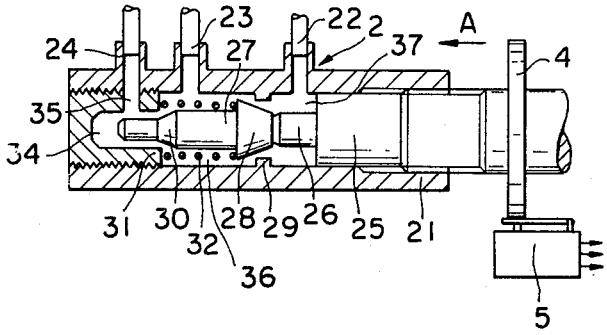
FIG. 5 is a view similar to FIG. 3 but showing the water stop valve in an open position.

As the operating knob 3 is further rotated as shown in FIG. 5, the axial projection 26 is moved in the direction of arrow A, pushing the main valve face 28 against the action of the coil spring 32 to open the valve. Whereupon, the supply chamber 36 is in fluid communication with both the discharge and recirculating chambers and, hence, the water from the pump 1 partly flows into the outlet port 22 and partly into the recirculating port 24. In this manner, the pressurized water from the pump 1 is fed to the outlet port 22 and then to the primary chamber 41 of the heater 6 through the water feed pipe 43. The water which is heated by the heating element 45 in the primary chamber 41 flows into the secondary chamber 42 through the communicating port 44 and heated to a desired temperature by the heater 47 before it is sprayed through the nozzle member 9 of the bidet portion 8. When the auxiliary valve face 30 engages with the seat 31 by further turning the knob 3, the supply chamber 36 is communicated only with the discharge chamber 37 so that no water is recycled through the recirculating chamber 34 to the suction side of the pump 1.

When the operating knob 3 is rotated in the reverse direction to reduce the flow rate of water through the nozzle member 9, the projection 26 is moved in the direction reverse to arrow A and the valve plug 27 is likewise moved in abutting engagement with the projection 26 by the action of the restoring action of the coil spring 32. As a result, the space between the main valve face 28 and main valve seat 29 is narrowed to diminish the flow rate of water to the outlet port 22, while the auxiliary valve face 30 is released from the auxiliary valve seat 31 to increase the flow rate of water which is returned to the suction side of the pump 1.

Figure 4:
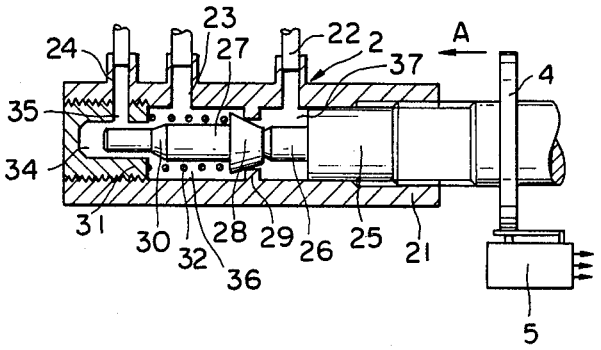
FIG. 4 is a view similar to FIG. 3 but showing the water stop valve in switch-on position.

The operating knob 3 is further rotated in the reverse direction in order to stop the feed of water to the heater 6. In this instance, the projection 26 is further moved as shown in FIG. 4 and disengaged from the main valve face 28. Thus, the valve face 28 is abutted against the main valve seat 29 by the action of the coil spring 32 to close the water passage from the supply chamber 36 to the discharge chamber 37. Under these circumstances, the pressurized water which is admitted into the supply chamber 36 through the inlet port 23 is entirely led into the recirculating chamber 34 and returned to the suction side of the pump 1. If the operating knob 3 is further rotated into the position shown in FIG. 3, the switch 5 is opened by the cam 4 to stop the pump 1 whereby the recirculating operation is terminated.

The recirculating passage which is provided between the water stop valve and the suction side of the water feed pump as described above serves to maintain the load of the pump 1 constant throughout the operation, precluding the troubles of the pump motor 1A which would otherwise be caused by load variations. It also serves to suppress abrupt variations in the discharge pressure even when the knob 3 is rotated quickly. Therefore, there is no possibility of cold water being sprayed from the nozzle due to a delay of response of the heater. In addition, overloading of the pump motor 1A is prevented even when the water stop valve is in a completely closed state, to suppress the motor troubles to a minimum. Further, the use of a heater with two chambers makes the temperature control more accurate and can reduce the surface area which contacts the atmosphere to thereby minimize the influences of the ambient temperature.

If the temperatures of the primary and secondary chambers 41 and 42 of the heater 6 reach respective predetermined values, the thermostats 46 and 48 are actuated to open the heater circuits. As soon as the water temperatures drop below predetermined values, the thermostats 46 and 48 close the heater circuits again to maintain the predetermined water temperatures. In the event the thermostats 46 and 48 fail to operate appropriately due to a trouble or by some reason, causing abnormal increases to the water temperatures in the primary and secondary chambers 41 and 42, the thermal fuse 49 or the manually resettable thermostat 50 is actuated to cut off the power supply to the pump or to open the power circuits of the heating elements 45 and 47. In such a case, the normal condition can be restored by replacing the fuse 49 after the water temperatures in the primary and secondary chambers drop to normal level and/or by manually resetting the thermostat 50 from outside the heater 6.

Figure 6:
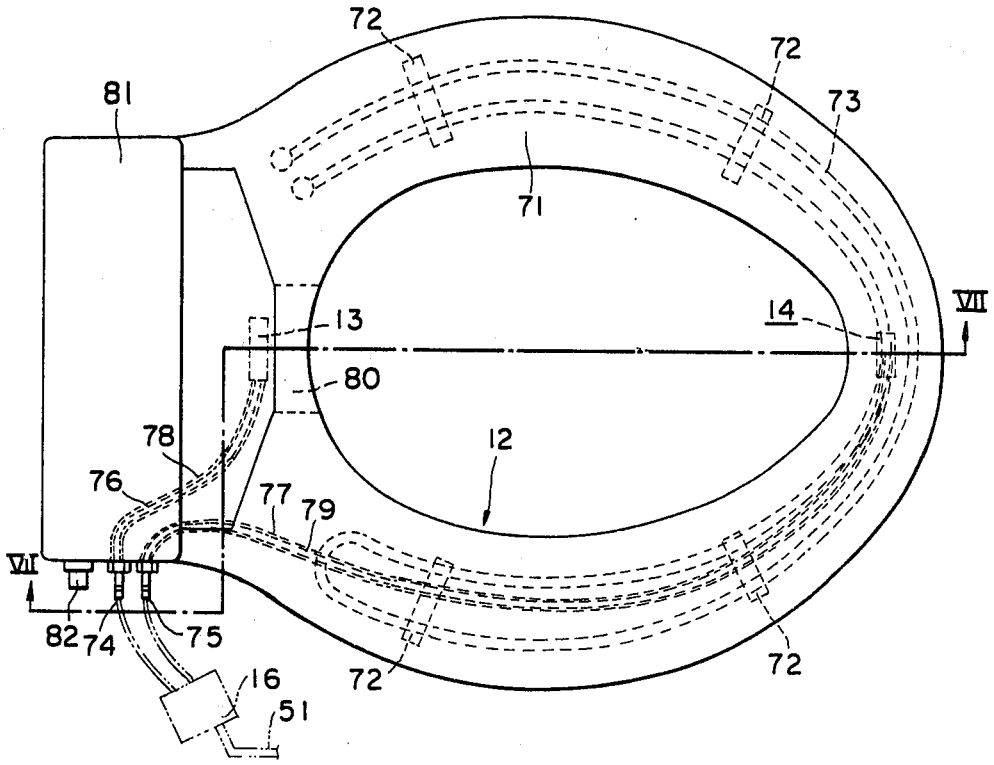
FIG. 6 is a plan view diagrammatically showing the bidet portion shown in FIG. 1.
Figure 7:
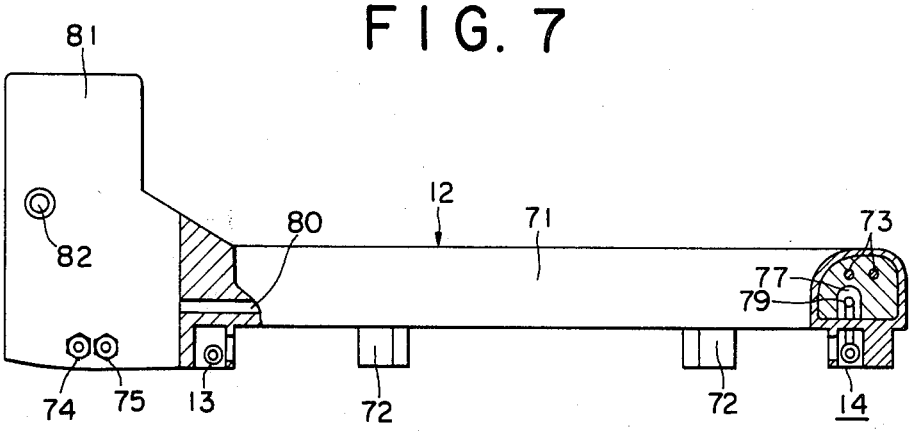
FIG. 7 is a cross-sectional view taken on line VII—VII of FIG. 6.

Referring to FIGS. 6 and 7 which show an embodiment of the seat for the bidet portion respectively in a plan view and in a section along line VII—VII, the reference numeral 12 indicates the toilet seat as a whole, including an annular closet or toilet seat 71 with a number of abutting members 72 on the underside thereof. The abutting members 72 are abutted against the surface of the rim of the bowl when the seat 71 is mounted thereon. Indicated at 73 is a heater which is embedded in the seat 71 for heating the seat during use. Mounted on the toilet seat 71 are a first nozzle member 13 which is projected out of the rear portion of the seat 71 on the underside thereof, and if necessary, a second nozzle member 14 which is projected out of the front portion of the seat 71 likewise on the underside thereof. The toilet seat 71 is provided with joint pieces 74 and 75 at suitable positions thereof in communication with the first and second nozzle members 13 and 14 through passages 76 and 77, respectively. The passages 76 and 77 are formed in the toilet seat 71 by, for example, pipes in the seat body. Thus, the nozzles 13 and 14 are provided independently of each other.

The reference numeral 80 denotes a heated air passage which is formed in the rear portion of the toilet seat body 71 and above the first nozzle member 13. Denoted at 81 is an air heater which accommodates in its casing a fan, a heater and a temperature control element and which is provided with a button switch 82 in the side wall of the casing. When the switch 82 is pressed on, the air heater 81 blows out heated air from the heated air passage 80 to dry the washed body portion.

Figure 8:
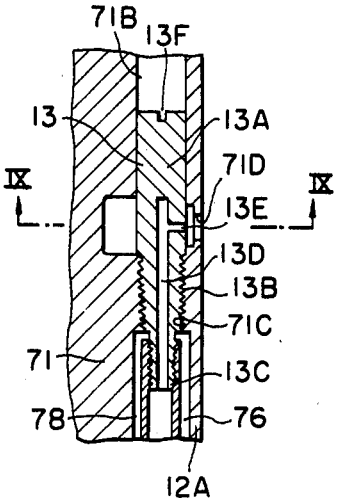
FIG. 8 is a fragmentary cross-section showing the details of a first nozzle member of FIG. 6.
Figure 9:
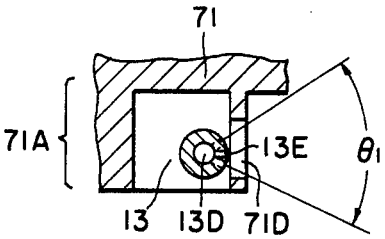
FIG. 9 is a cross-sectional view taken on line IX—IX of FIG. 8.

Referring now to FIGS. 8 and 9 which illustrate the details of the first nozzle 13, designated at 13A is a cylindrical nozzle body proper which is tightly fitted into a cavity 71B of a nozzle holder 71A which in turn is provided integrally with the bottom end portion of the seat body 71, with a male screw portion 13B of the nozzle 13 threaded into a female screw portion 71C of the bore 71B to prevent movements of the nozzle 13 in the longitudinal direction. The cavity 71B is in communication with the passage 76. A connecting portion 13C which is provided at one end of the nozzle body 13A is coupled with the pipe 78 from the joint piece 74. The nozzle body 13A is centrally provided with a water passage 13D in communication with a spray nozzle 13E which is disposed to spurt heated water toward the anal region of a seated user through a slot 71D in the seat body 71. The angle of the spray nozzle 13E is adjustable within the range of the angle $\theta_1$ by turning a screw driver in a groove 13F on the outer end face of the nozzle body 13A.

Figure 10:
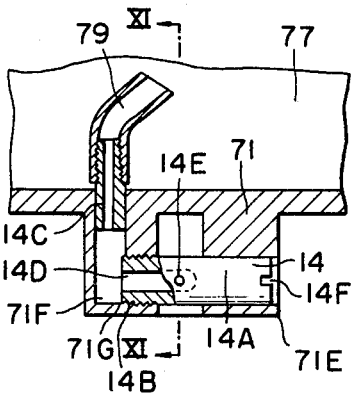
FIG. 10 is a fragmentary cross-section showing the details of a second nozzle member of FIG. 6.
Figure 11:
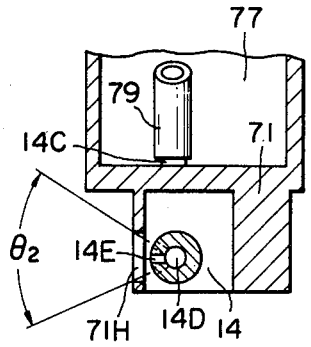
FIG. 11 is a cross-sectional view taken on line XI—XI of FIG. 10.

Similarly, the second nozzle member 14 includes a nozzle body 14A, a male screw portion 14B, a joint piece 14C, a water passage 14D, a spray nozzle 14E and a groove 14F as shown in FIGS. 10 and 11. The nozzle body 14A is tightly fitted into a cavity 71F of a nozzle holder 71E which is provided on the underside of the seat body 71, with the male screw portion 14B threaded into a female screw portion 71G of the cavity 71F. Indicated at 14C is a connecting piece which has one end thereof securely fixed in the cavity 71F and the other end connected to the pipe 79 led from the joint member 75. The orientation of the nozzle 14E from which heated water is sprayed through a slot 71H is adjustable within the range of angle $\theta_2$.

The joint pieces 74 and 75 are connected to the heated water feed pipe 51 through a change-over valve 16. Before connecting the washing device to a power source to supply current to the respective electrically operating parts, the first nozzle member 13 and/or the second nozzle member 14 is rotated into a position in which a desired angle of water jet is obtained.

In the case of anal washing, the change-over valve 16 is switched to a rear washing position to supply heated water to the joint piece 74, spraying heating water through the first nozzle member 13 of the toilet seat 12 to wash the anal region. As soon as the washing operation finishes, the heat controlled air blower 81 is actuated to send out warm breezes through the heated air passage 80 to remove moisture from the washed anal region.

If a female likes to use the washing device after urination, the change-over valve 16 is switched to the front washing portion to supply heated water to the joint piece 75, whereupon heated water is sprayed from the spray nozzle 14E to wash the urinary part. Thereafter, warm breeze is blown out of the heated air passage 80 to dry the washed part in the same manner as in the rear washing operation.

It is to be understood that the toilet seat may be provided with either the rear nozzle 13 or the front nozzle 14 alone depending upon the purpose of use. The nozzle member which has been shown as a fixed type may be provided at the tip end of a flexible tube which is adapted to be handled manually.

Figure 12:
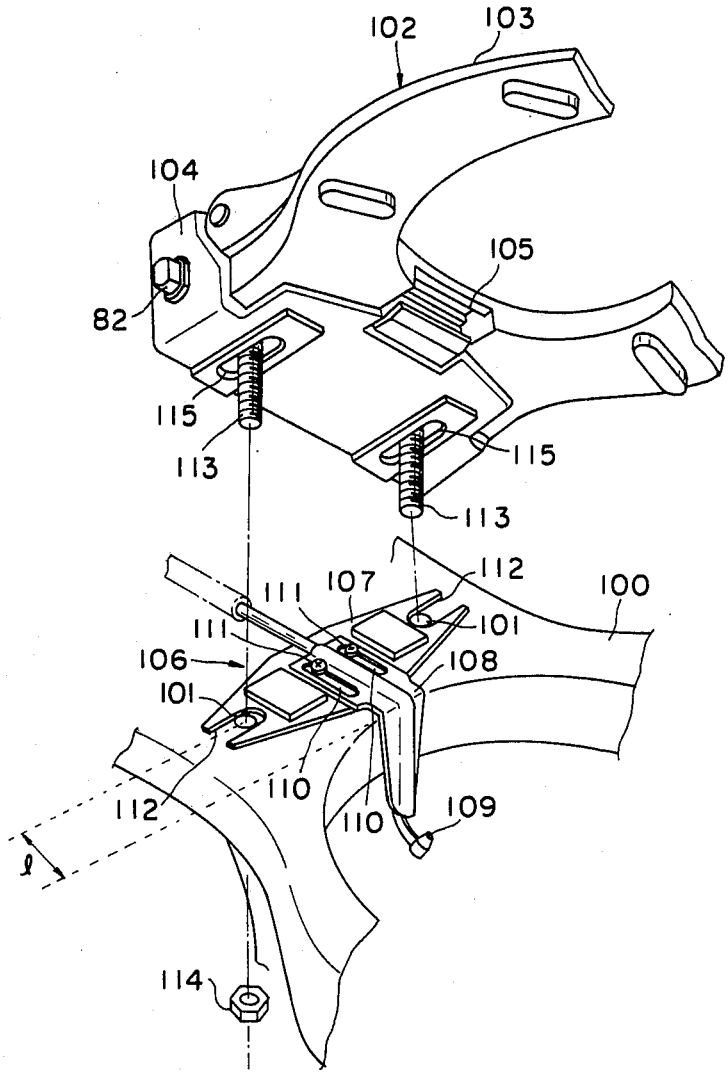
FIG. 12 is an exploded view diagrammatically showing a toilet seat/nozzle assembly according to the invention.

The heat controlled washing device of the present invention can be mounted on the conventional water-closet. FIG. 12 illustrates one example of a toilet seat/-nozzle assembly as mounted on a conventional water closet, in which indicated at 100 is a water-closet proper with a pair of holdes 101 for fixing a toilet seat assembly 102 thereon. The toilet seat assembly 102 includes a seat 103 which has a heating element or elements (not shown) embedded therein, and a base portion 104 which pivotally supports the seat 103. The base portion 104 accommodates therein a heat controlled air blower to send out warm breezes through a guide hole 105 in the seat 103. Denoted generally at 106 is a nozzle member which has a nozzle mounting plate 107 and an L-shaped movable plate 108, with a heated water spray nozzle 109 fixed on the movable plate 108. The movable plate 108 is provided with a pair of slots 110 and fixed to the mounting plate 107 by screws 111. The mounting plate 107 is provided with notches 112 in vertical alignment with the holes 101 in the closet of bowl 100. The mounting plate 107 can adapt itself to various closet with the mounting holes 101 at different distances as long as the holes fall within the length of the notches 112. On the other hand, the variations in the distance l between the mounting holes 101 and the inner edge of the bowl rim can be absorbed by the lengths of the slots 110. Thus, the nozzle assembly 106 can be mounted on most of ordinary water-closets.

The toilet seat/nozzle assembly of the above-described construction is mounted on an already installed water-closet in the following manner. After removing the currently attached seat, the nozzle assembly 106 is placed on the closet 100 with the notches 112 of the mounting plate 107 in registry with the holes 101 of the closet 100. Then, the movable plate 108 is fixed to the mounting plate 107 by tightening the screws 111 in such a position that the angularly bent surface of the movable plate 108 contacts the inner periphery of the bowl rim of the closet 100. The nozzle and seat assemblies 106 and 102 are fixed to the closet 100 by passing through the holes 101 of the closet 100 the bolts 113 which are projected downwardly from the base portion of the seat assembly 102, and tightening the nuts 114 on the bolts 113. Since the bolts 113 are slidable back and forth along the slots 115 in the base portion 104, the seat assembly 102 is adaptable to various closet of different dimensions in the length of l owing to the provision of the slots 115 in the base portion 104.

Figure 13:
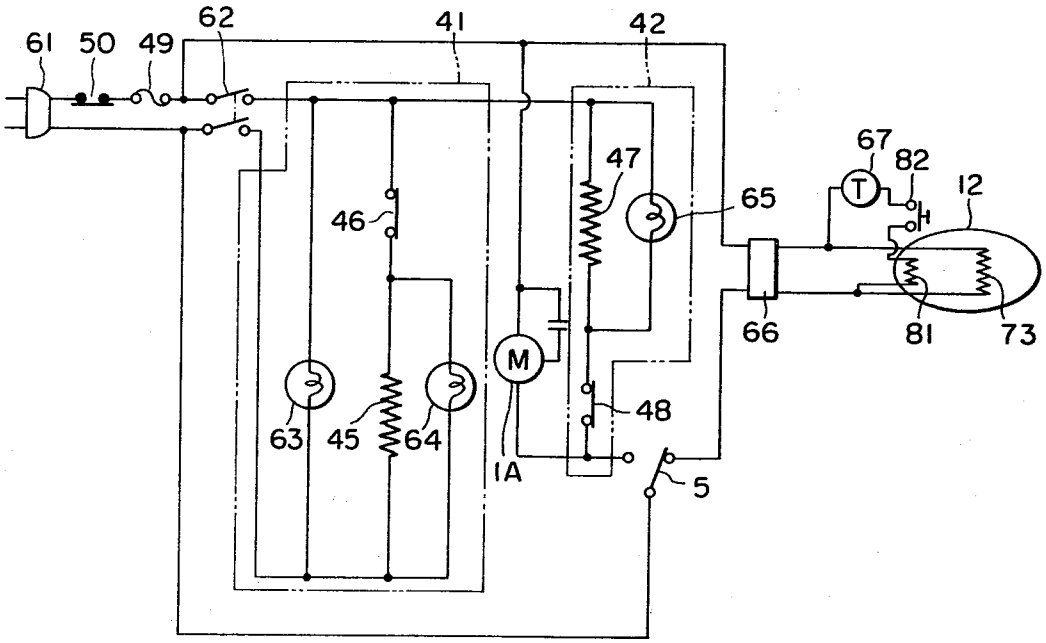
FIG. 13 is an electric circuit diagram for the heat-controlled sanitary bathing and drying device according to the invention.

FIG. 13 is a diagram of an exemplary electric control circuit for the closet with the heat controlled washing and drying system according to the present invention, wherein designated at 5 is an actuator switch as shown in FIG. 1, at 61 a plug to be connected to a power source, at 62 a switch for turning on and off the heating elements 45 and 47, at 63 a lamp for indicating the on- and off-states of the switch 62, at 64 and 65 lamps for indicating the conductive and non-conductive states of the heating elements 45 and 47, and at 66 a plug socket on the toilet seat 12 (indicated at 102 in FIG. 12).

Thus, the motor 1A of the water feed pump 1 is connected parallel with the plug socket 66 of the toilet seat 12, and connected to the plug of the power source through the thermostat 50, thermal fuse 49 and switch 5. The primary chamber 41 of the heater 6 is heated by completing a loop constituted by the plug 61, thermostat 50, thermal fuse 49, switch 62, thermostat 46, heating element 45, switch 62 and plug 61, while the secondary chamber 42 is heated by completing a loop constituted by the plug 61, thermostat 50, thermal fuse 49, switch 62, heating element 47, thermostat 48, switch 5 and plug 61.

In operation, if the plug 61 is connected to a power source with the switches 5 and 62 in the position shown, the plug socket 66 of the heat controlled toilet seat is connected to the power source through the switch 5 and the heater 73 of the seat 12 is energized as soon as the plug of the seat 12 is connected to the plug socket 66.

Upon turning on the switch 62, the lamps 63 to 65 are lit and the loops through the heating elements 45 and 47 of the primary and secondary chambers 41 and 42 are completed to heat water in the primary and secondary chambers 41 and 42 to predetermined temperature levels. If the water temperatures in the primary and secondary chambers 41 and 42 exceed a predetermined value, the thermostat 46 or 48 is actuated to break the circuit of the heating element 45 or 47 to suspend the heating by the heating element 45 or 47, and the indicator lamp 64 or 65 is turned off simultaneously.

If the thermostat 46 or 48 fails to break the heating circuit even through the water temperature in the primary or secondary chambers 41 or 42 exceeds a predetermined value, the thermal fuse 49 is blown off to break the heating circuit through the heating element 45 and 47, and the indicator lamps 63 to 65 are turned off at the same time. If the lamp 63 is turned off when the switch 62 is on, it means that the thermal fuse 49 is blown off or the thermostat 50 is turned off. In such a case, the circuit to the plug socket 66 as well as the circuit to the pump drive motor is opened.

After washing, the water control valve 2 is closed by turning the knob 3, whereupon the switch 5 assumes again the off-position as shown in FIG. 13 and the motor 1A stops. Under these circumstances, if the switch 82 is depressed, the timer 67 is actuated and the hot air blower is started to send out warm breezes through the passage 80 (indicated at 105 in FIG. 12) for the time period set by the timer 67 for the drying operation.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

I claim:

1. In a water-closet apparatus with a heat-controlled bathing system, including a heater for heating feed water to a predetermined temperature, a bidet portion having nozzle means adapted for spraying heated water supplied from said heater, a pump for feeding water to said heater and nozzle means, and a valve means for controlling the flow rate of water to said heater, the improvement which comprises:

said control valve means comprising a tubular valve casing defining axially contiguously aligned discharge, supply and recirculating chambers therein; an inlet port provided in said valve casing at a location so that feed water from said pump may be supplied to said supply chamber therethrough; a discharge port provided in said valve casing at a location so that feed water in said discharge chamber may be fed to said heater therethrough; a recirculating port provided in said valve casing at a location so that the feed water in said recirculating chamber may be recirculated to the suction side of said pump; main and auxiliary valve seats provided in said valve casing at positions between said discharge and supply chambers and between said supply and recirculating chambers, respectively; a valve plug axially movably accommodated in said supply chamber and having main and auxiliary valve faces cooperable with said main and auxiliary valve seats, respectively, for controlling the rate of water flowing therethrough, said valve plug being constantly urged to engage said main valve face with said main valve seat; and a valve stem threaded into said valve casing for axial movements and having a portion adapted for abutting engagement with said valve plug for displacing said valve plug so that, by turning said valve stem, feed water supplied to said supply chamber from said pump may be admitted into either one or both of said discharge and recirculating chambers; and said heater comprising an outer vessel; an inner vessel defining a primary chamber therein and placed inside of said outer vessel to define a secondary chamber therebetween; a water feed pipe extending between said primary chamber and said outlet port of said water control valve; an opening provided in an upper portion of said primary chamber so that said primary chamber is in fluid communication with said secondary chamber; first and second heating means for heating water in said primary and secondary chambers to predetermined temperature levels, respectively; a heated water feed means extending between said secondary chamber and said nozzle means; and means for stopping operation of said pump when the water temperature in said secondary chamber exceeds said predetermined temperature level.

2. The apparatus as set forth in claim 1, wherein said bidet portion further includes a seat member with a built in heating means.

3. The apparatus as set forth in claim 2, wherein said bidet portion further includes means for feeding warm breeze for a predetermined period of time.

4. The apparatus as set forth in claim 3, wherein said nozzle means includes two spray nozzles respectively provided at front and rear ends of said bidet portion and a selector for selectively feeding heated water from said heater to either one of said two spray nozzles.

5. The apparatus as set forth in claim 3, wherein said nozzle means include a mounting plate fixed on a closet of said bidet portion by fixing means for fixing said seat member on said closet, and a spray nozzle secured to said mounting plate.

* * * * *